US012385280B2

(12) United States Patent
Randel

(10) Patent No.: US 12,385,280 B2
(45) Date of Patent: Aug. 12, 2025

(54) POST MOUNT INSTALLATION DEVICE AND METHOD OF USE

(71) Applicant: Joel Randel, Prescott, AZ (US)

(72) Inventor: Joel Randel, Prescott, AZ (US)

( * ) Notice: Subject to any disclaimer, the term of this patent is extended or adjusted under 35 U.S.C. 154(b) by 297 days.

(21) Appl. No.: 18/101,887

(22) Filed: Jan. 26, 2023

(65) Prior Publication Data

US 2024/0254803 A1 Aug. 1, 2024

(51) Int. Cl.
*E04H 17/26* (2006.01)

(52) U.S. Cl.
CPC ..... *E04H 17/263* (2013.01)

(58) Field of Classification Search
CPC ..... E04H 17/263; E04H 12/2253
USPC ..... 269/17
See application file for complete search history.

(56) References Cited

U.S. PATENT DOCUMENTS

| | | | | |
|---|---|---|---|---|
| 4,483,506 | A | 11/1984 | Litwiller | |
| 5,961,242 | A | 10/1999 | Leone | |
| 6,658,753 | B2 | 12/2003 | Tatarnic | |
| D748,505 | S | 2/2016 | Watson | |
| 10,655,359 | B2 | 5/2020 | Hemingway | |
| 11,253,989 | B1 | 2/2022 | Bock | |
| 11,307,013 | B2 | 4/2022 | MacArthur | |
| 2015/0167889 | A1* | 6/2015 | Stremlau | F16M 11/045 29/428 |
| 2016/0023229 | A1* | 1/2016 | Johnson | B25H 1/0007 269/152 |

FOREIGN PATENT DOCUMENTS

| | | |
|---|---|---|
| CA | 2331600 | 7/2002 |

* cited by examiner

*Primary Examiner* — Christopher J. Besler

(57) ABSTRACT

A post mount installation device enabling installation of a plurality of posts with the posts being substantially parallel and coplanar includes a first pipe, a second pipe, and a third pipe. The first pipe is removably attachable to a first post mount. The second pipe is attached to and extends perpendicularly from the first pipe so that an upper limit of the second pipe is substantially coplanar with an upper end of the first post mount. The second pipe also is substantially parallel to an imaginary line that extends between the first post mount and a location for installation of a second post mount. The third pipe is slidably attached to the second pipe and thus is selectively extensible from the second pipe. A respective opposed end of the third pipe indicates a point adjacent to the location for installation of the second post mount.

5 Claims, 6 Drawing Sheets

POST MOUNT INSTALLATION DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to installation devices and more particularly pertains to a new installation device enabling installation of a plurality of posts with the posts being substantially parallel and coplanar. The present invention discloses an installation device for post mounts that enables a user to install the post mounts properly so that posts subsequently attached to the post mounts are parallel and coplanar.

(2) Description of Related Art Including Information Disclosed Under 37 CFR 1.97 and 1.98

The prior art relates to installation devices, which may comprise an extensible rod have clamping members or brackets at each end that are attachable to posts. While these installation devices are useful in positioning posts, many fencing systems and support systems using multiple posts rely on post mounts that are attached to or positioned in the ground. These prior art installation devices do not enable proper positioning of post mounts. Related prior art includes post location marking devices, which may include a pair of pipes and a crossmember, and drilling jigs having two collars slidably attached to a crossmember. What is lacking in the prior art is an installation device that is attachable to a first post mount and which can be used to indicate proper positioning of a second post mount.

BRIEF SUMMARY OF THE INVENTION

An embodiment of the disclosure meets the needs presented above by generally comprising a first pipe, a second pipe, and a third pipe. The first pipe is configured to be removably attachable to a first post mount. The second pipe is attached to and extends perpendicularly from the first pipe so that an upper limit of the second pipe is substantially coplanar with an upper end of the first post mount. The second pipe also is substantially parallel to an imaginary line that extends between the first post mount and a location for installation of a second post mount. The third pipe is slidably attached to the second pipe and thus is selectively extensible from the second pipe. A respective opposed end of the third pipe is configured to indicate a point adjacent to the location for installation of the second post mount.

Another embodiment of the disclosure includes a method for installing post mounts. Provision steps entail providing a plurality of post mounts and providing a post mount installation device, according to the disclosure above. Operational steps are installing a first post mount, attaching the first pipe to the first post mount, extending the third pipe from the second pipe such that a respective opposed end of the third pipe is positioned to indicate a point adjacent to a location for installation of a second post mount, installing the first second mount, and repeating as necessary until all post mounts have been installed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
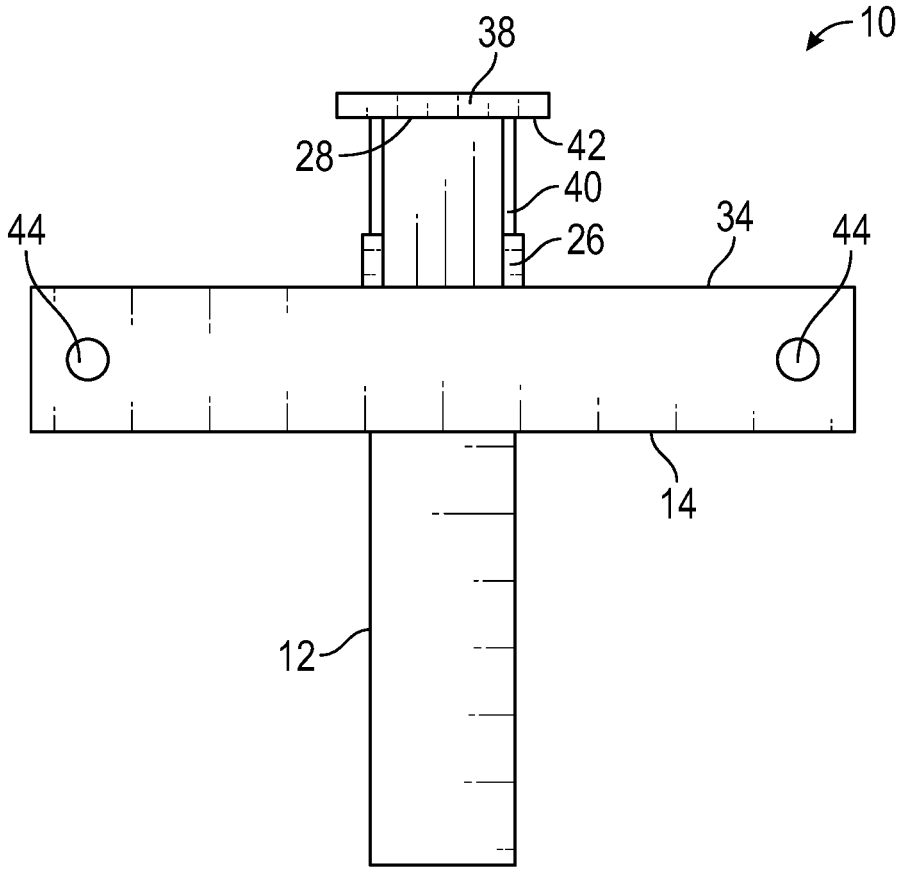
FIG. 1 is a front view of a post mount installation device according to an embodiment of the disclosure.
Figure 2:
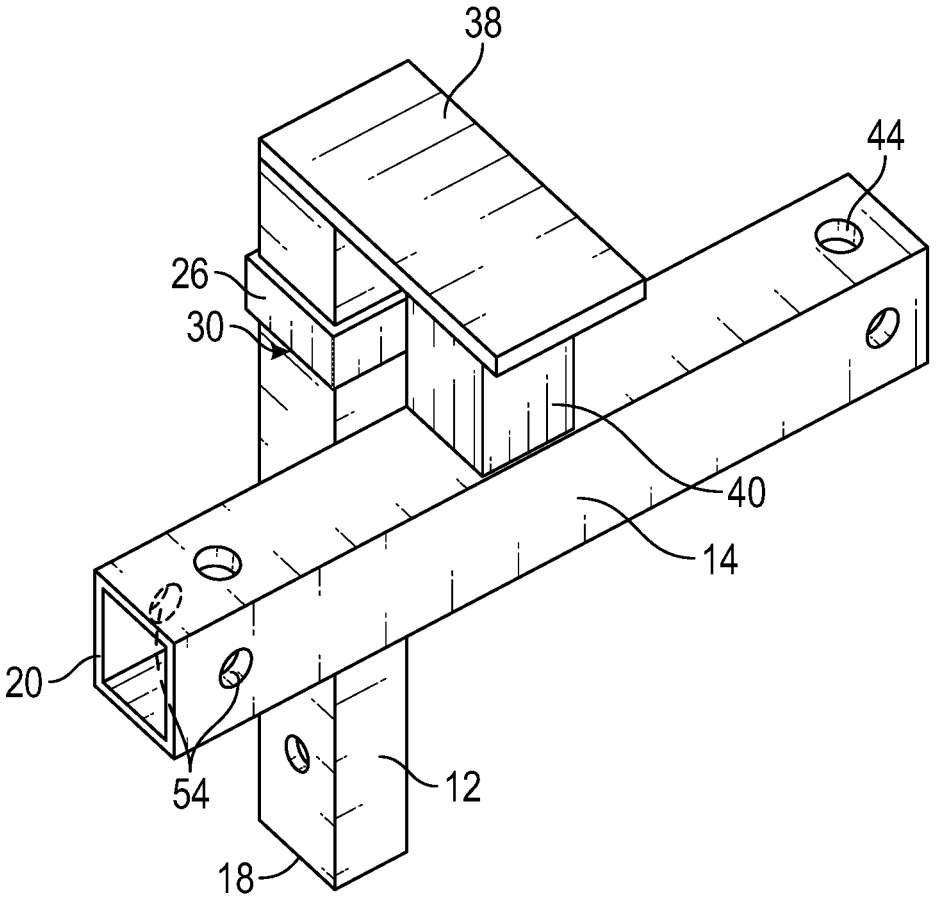
FIG. 2 is an isometric perspective view of an embodiment of the disclosure.
Figure 3:
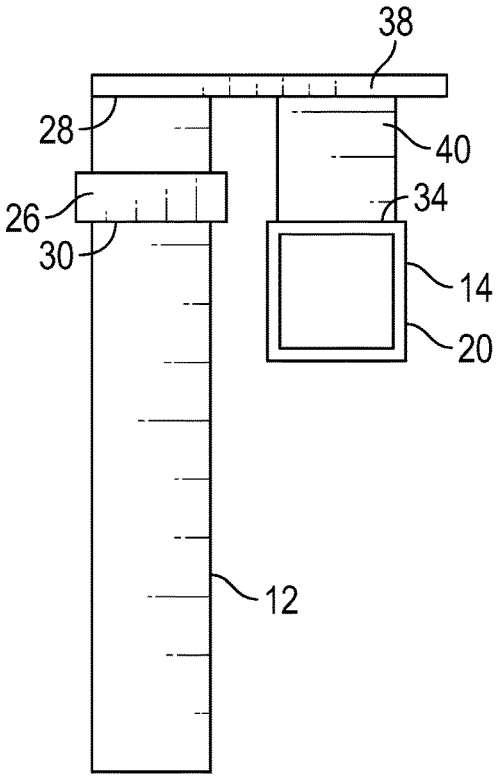
FIG. 3 is a side view of an embodiment of the disclosure.
Figure 4:
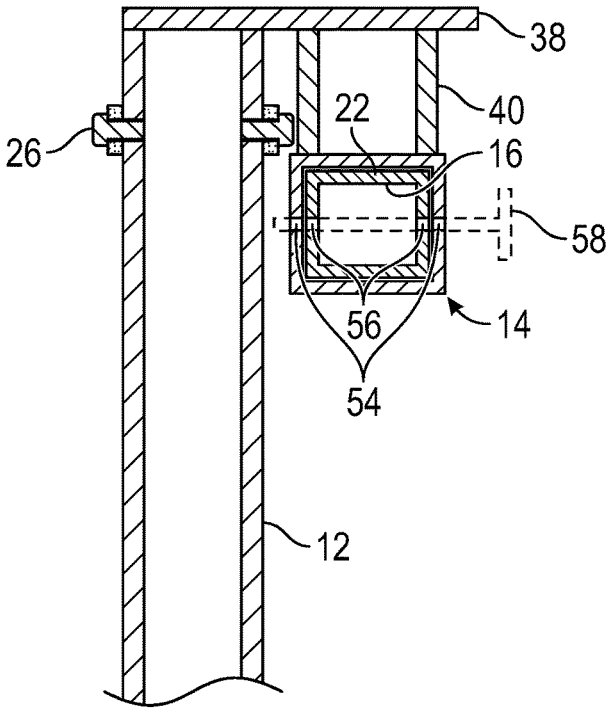
FIG. 4 is a cross-sectional view of an embodiment of the disclosure.

With reference now to the drawings, and in particular to FIGS. 1 through 7 thereof, a new installation device embodying the principles and concepts of an embodiment of the disclosure and generally designated by the reference numeral 10 will be described.

As best illustrated in FIGS. 1 through 7, the post mount installation device 10 generally comprises a first pipe 12, a second pipe 14, and a third pipe 16, each of which have a cross-sectional profile. As shown in FIGS. 1-6, the cross-sectional profiles of the first pipe 12, the second pipe 14, and the third pipe 16 are square. The present invention also anticipates the cross-sectional profile 18 of the first pipe 12 being alternatively shaped so as to match shapes of various post mounts 64, such as, but not limited to, circular, rectangular, hexagonal, and the like. Additionally, the present invention anticipates the cross-sectional profile 20 of the second pipe 14 and the cross-sectional profile 22 the third pipe 16 being alternatively shaped, with the only limitation being that the cross-sectional profile 20 of the second pipe 14 is complementary to the cross-sectional profile 22 of the third pipe 16, for reasons that are made apparent below.

Figure 5:
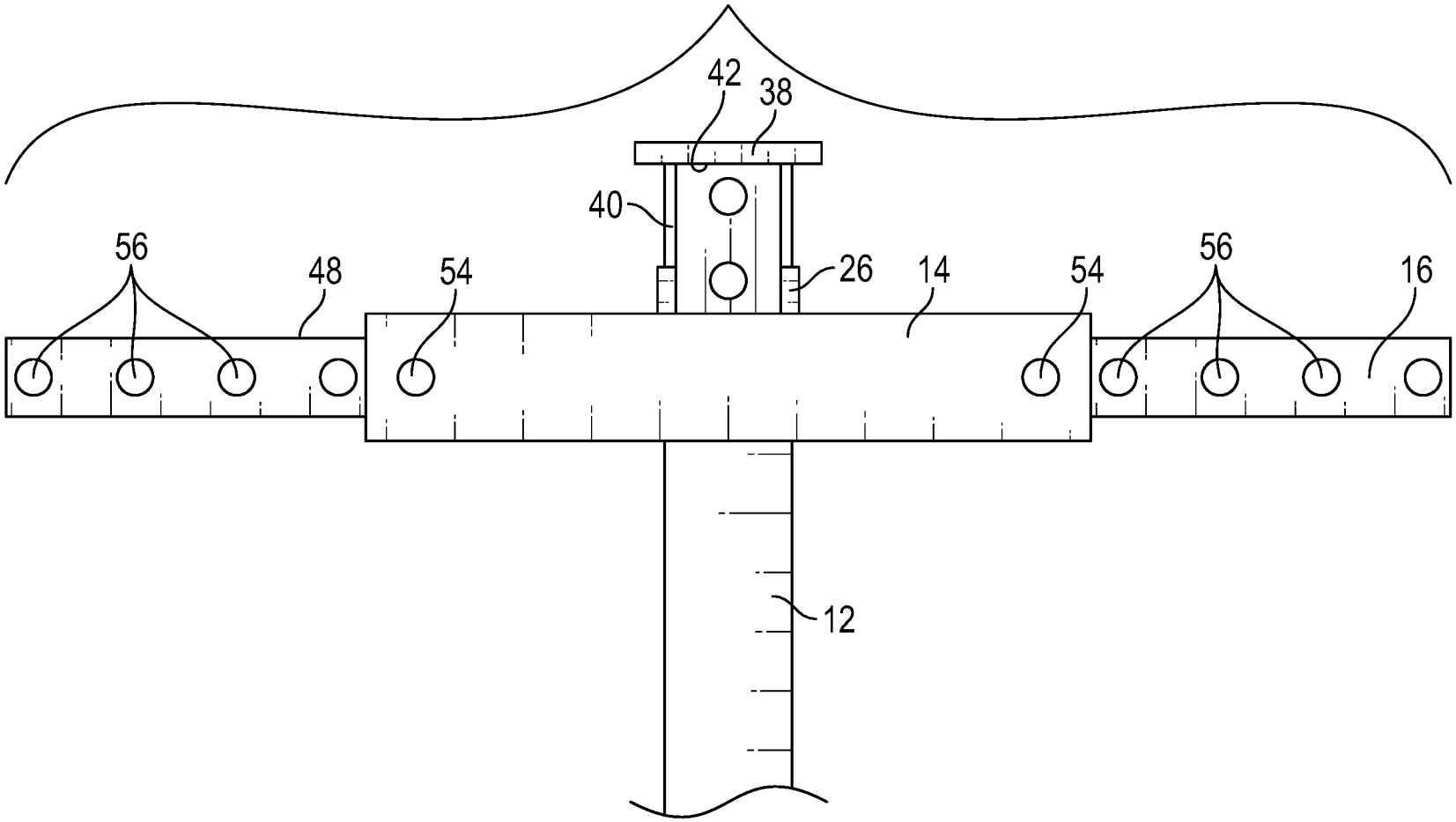
FIG. 5 is an in-use view of an embodiment of the disclosure.
Figure 6:
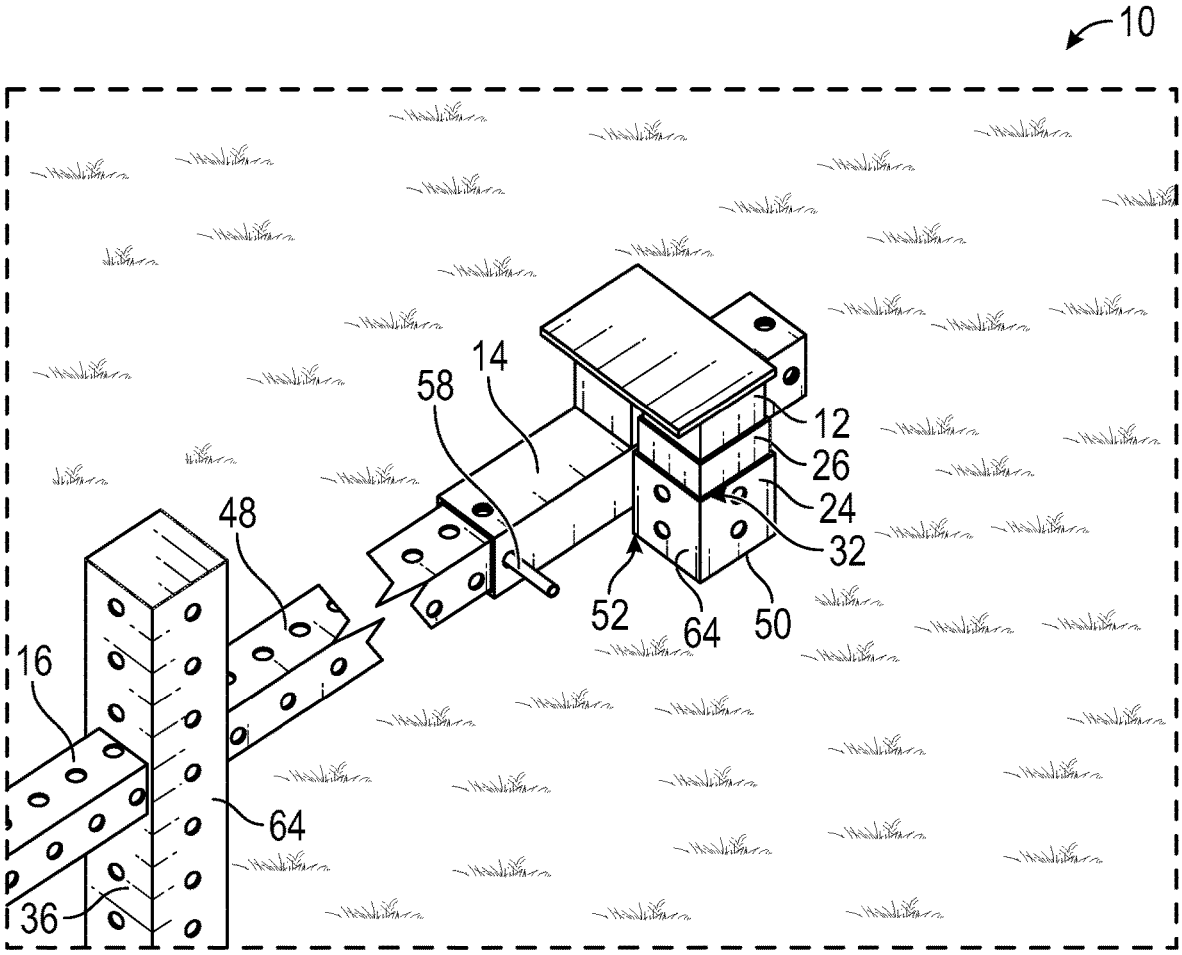
FIG. 6 is an in-use view of an embodiment of the disclosure.
Figure 7:
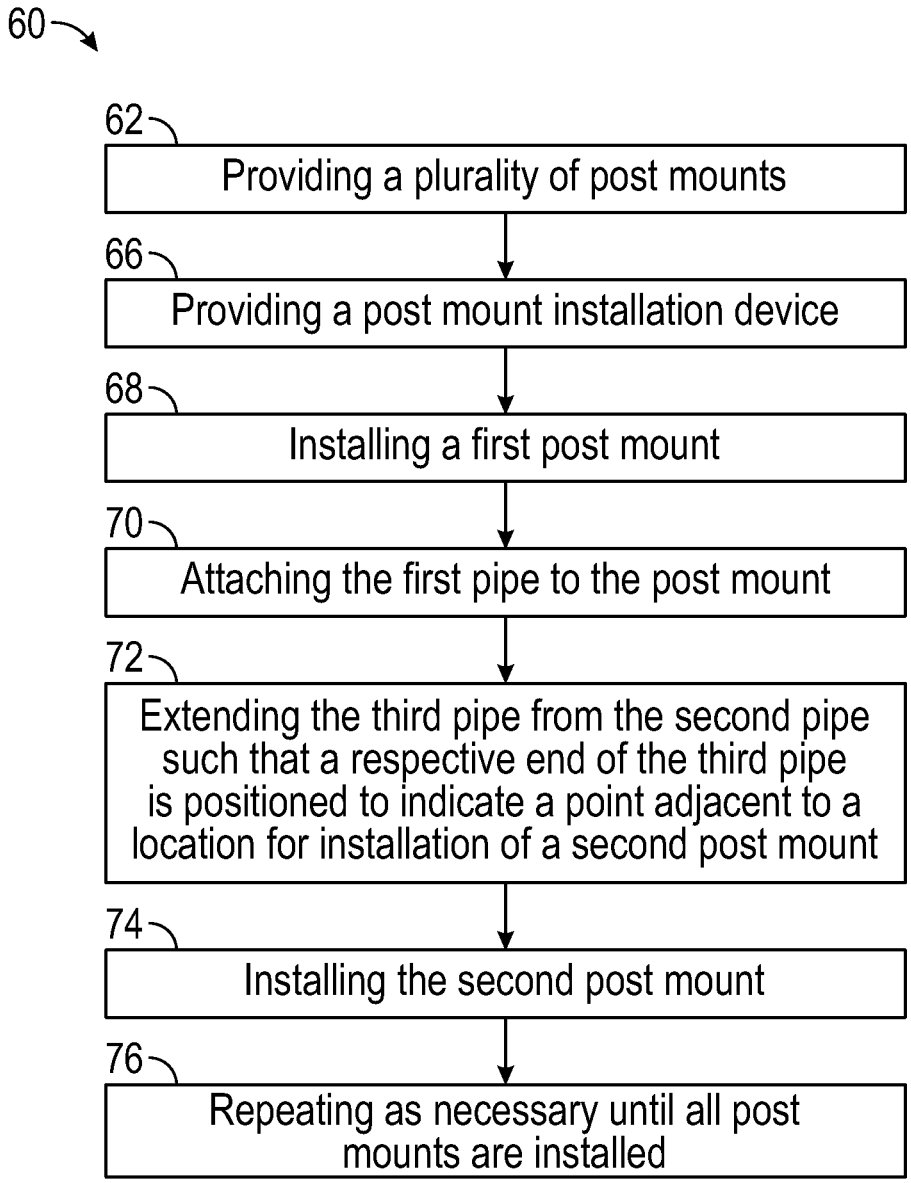
FIG. 7 is a flow diagram for a method utilizing an embodiment of the disclosure.

The first pipe 12 is configured to be removably attachable to a first post mount 24, as shown in FIGS. 5 and 6. The first pipe 12 is circumferentially complementary to the first post mount 24 and thus is configured to be selectively inserted into the first post mount 24 to removably attach the first pipe 12 to the first post mount 24. A collar 26 is attached to and extends circumferentially around the first pipe 12 proximate to an upper terminus 28 of the first pipe 12. A lower limit 30 of the collar 26 is configured to rest on an upper end 32 of the first post mount 24 upon insertion the of first pipe 12 into the first post mount 24, as shown in FIG. 6.

The second pipe 14 is attached to and extends perpendicularly from the first pipe 12 so that an upper limit 34 of the second pipe 14 is substantially coplanar with the upper end 32 of the first post mount 24. The second pipe 14 also is substantially parallel to an imaginary line that extends between the first post mount 24 and a location for installation of a second post mount 36. The second pipe 14 may be attached to the first pipe 12 by means of a plate 38 and a spacer 40. The plate 38 is attached to and extends from the upper terminus 28 of the first pipe 12. The spacer 40 is attached to a lower face 42 of the plate 38, distal from the first pipe 12, and also is attached to the second pipe 14 so that the upper limit 34 of the second pipe 14 is substantially coplanar with the lower limit 30 of the collar 26. In another configuration (not shown) of the post mount installation device 10, the first post mount 24 is insertable into first pipe 12 and the second pipe 14 is attached directly to the first pipe 12.

The third pipe 16 is slidably attached to the second pipe 14 and thus is selectively extensible from the second pipe 14. The third pipe 16 is circumferentially complementary to the second pipe 14 so that the third pipe 16 is slidable within the second pipe 14. A fastener 44 is attached to the second pipe 14 and is configured to enable attachment of the second pipe 14 to the third pipe 16 to fixedly position the third pipe 16 relative to the second pipe 14. A respective opposed end 46 of the third pipe 16 is configured to indicate a point adjacent to the location for installation of the second post mount 36.

It often is required to install a plurality of posts so that the posts are substantially parallel and substantially coplanar, as might be the case when two or three posts are installed to support a sign. Upon installation of a first post mount 24, it can be difficult to properly install a second post mount 36 so that one ends up with posts that are substantially parallel and substantially coplanar. The same holds true for subsequent post mounts 64 that might need to be installed. The post mount installation device 10 facilitates proper installation of the second post mount 36, and subsequent post mounts 64, by properly spacing the second post mount 36 from the first post mount 24, via selective extension of the third pipe 16, and by assuring that the first post mount 24 and second post mount 36 are level, as the upper end 32 of the first post mount 24 is flush with a top 48 of the third pipe 16.

The post mount installation device 10 also can assist in installing the first post mount 24 so that it is oriented as desired relative to a reference line, such as in providing a plurality of posts in a vertical plane that is substantially perpendicular to a roadway. It can be difficult to install the first post mount 24 so that its front edge 50 and back edge 52 are perpendicular (or other desired angle) relative to a reference line. It is much easier to achieve the desired orientation with the first post mount 24 by removably attaching it to the post mount installation device 10. Prior to final attachment to the surface, the first post mount 24 can be checked for level by positioning a level (not shown) upon the third pipe 16. The third pipe 16 also is much easier to relate to the reference line than are the front edge 50 and the back edge 52 of the first post mount 24, which are much shorter that the third pipe 16.

The fastener 44 may comprise a pair of first holes 54, the first holes 54 of which are opposingly positioned in the second pipe 14. A plurality of second holes 56 is positioned in the third pipe 16 so that the second holes 56 are substantially evenly spaced between the opposed ends 46 of the third pipe 16. Each second hole 56 is opposingly positioned in the third pipe 16 relative to an associated second hole 56. A pin 58 is selectively insertable through the pair of first holes 54, a respective second hole 56, and an associated second hole 56 to fixedly position the third pipe 16 relative to the second pipe 14. The second holes 56 may be separated by defined increments, such as one inch. The present invention anticipates the fastener 44 comprising other fastening means, such as, but not limited to, twist locks, clamps, spring-loaded pins, and the like.

The present invention also anticipates a bracket, a socket, or the like (not shown) that is attached to the third pipe 16 proximate to the respective opposed end 46 that is positioned adjacent to the location for installation of the second post mount 36. The bracket or socket would support the second post mount 36 during installation, allowing it to be more easily plumbed and installed.

In use, the post mount installation device 10 enables a method for installing post mounts 60, which comprises a first provision step 62 that entails providing a plurality of post mounts 64. A second provision step 66 of the method 60 is providing a post mount installation device 10, according to the specification above. A first operational step 68 of the method 60 is installing a first post mount 24. A second operational step 70 of the method 60 is attaching the first pipe 12 to the first post mount 24. A third operational step 72 of the method 60 is extending the third pipe 16 from the second pipe 14 so that a respective opposed end 46 of the third pipe 16 is positioned to indicate a point adjacent to a location for installation of a second post mount 36. A fourth operational step 74 of the method 60 is installing the second post mount 36. A fifth operational step 76 of the method 60 is repeating as necessary until all the post mounts 64 are installed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A post mount installation device comprising:

a first pipe configured to be removably attachable to a first post mount, wherein the first pipe has a free end being circumferentially complementary to the first post mount, wherein the free end of the first pipe is configured for selective insertion into the first post mount for removably attaching the first pipe to the first post mount;

a second pipe attached to and extending perpendicularly from relative to the first pipe, such that an upper limit of the second pipe is substantially coplanar with an upper end of the first post mount, and such that the second pipe is substantially parallel to an imaginary line extending between the first post mount and a location for installation of a second post mount;

a third pipe slidably attached to the second pipe, such that the third pipe is selectively extensible from the second pipe, wherein a respective opposed end of the third pipe is configured for indicating a point adjacent to the location for installation of the second post mount;

a collar attached to and extending circumferentially around the first pipe proximate to an upper terminus of the first pipe, wherein a lower limit of the collar is configured for resting upon the upper end of the first post mount upon insertion the of first pipe into the first post mount;

a plate attached to and extending from the upper terminus of the first pipe; and a spacer attached to a lower face of the plate distal from the first pipe, the spacer being attached to the second pipe, such that the upper limit of the second pipe is substantially coplanar with the lower limit of the collar.

2. The post mount installation device of claim 1, further including a fastener attached to the second pipe and being configured for enabling attachment of the second pipe to the third pipe for fixedly positioning the third pipe relative to the second pipe.

3. The post mount installation device of claim 2, further including:

the third pipe being circumferentially complementary to the second pipe, such that the third pipe is slidable within the second pipe;

the fastener comprising:

a pair of first holes, the first holes of the pair of first holes being opposingly positioned in the second pipe;

a plurality of second holes positioned in the third pipe such that the second holes of the plurality of second holes are substantially evenly spaced between opposed ends of the third pipe and such that each second hole of the plurality of second holes is opposingly positioned in the third pipe relative to an associated second hole of the plurality of second holes; and a pin selectively insertable through the pair of first holes, a respective second hole, and the associated second hole for fixedly positioning the third pipe relative to the second pipe.

4. The post mount installation device of claim 1, wherein each of the first pipe, the second pipe, and the third pipe have a cross-sectional profile, the cross-sectional profile of each of the first pipe, the second pipe, and the third pipe being square.

5. A mounting base installation device comprising:

a first pipe configured to be removably attachable to a first post mount, the first pipe having a free end being circumferentially complementary to the first post mount, wherein the free end of the first pipe is configured for selective insertion into the first post mount for removably attaching the first pipe to the first post mount;

a second pipe attached to and extending perpendicularly relative to the first pipe, such that an upper limit of the second pipe is substantially coplanar with an upper end of the first post mount, and such that the second pipe is substantially parallel to an imaginary line extending between the first post mount and a location for installation of a second post mount;

a third pipe slidably attached to the second pipe, such that the third pipe is selectively extensible from the second pipe, wherein a respective opposed end of the third pipe is configured for indicating a point adjacent to the location for installation of the second post mount, the third pipe being circumferentially complementary to the second pipe, such that the third pipe is slidable within the second pipe, each of the first pipe, the second pipe, and the third pipe have a cross-sectional profile, the cross-sectional profile of each of the first pipe, the second pipe, and the third pipe being square;

a collar attached to and extending circumferentially around the first pipe proximate to an upper terminus of the first pipe, wherein a lower limit of the collar is configured for resting upon the upper end of the first post mount upon insertion the of first pipe into the first post mount;

a plate attached to and extending from the upper terminus of the first pipe;

a spacer attached to a lower face of the plate distal from the first pipe, the spacer being attached to the second pipe, such that the upper limit of the second pipe is substantially coplanar with the lower limit of the collar;

a fastener attached to the second pipe and being configured for enabling attachment of the second pipe to the third pipe for fixedly positioning the third pipe relative to the second pipe, the fastener comprising:

a pair of first holes, the first holes of the pair of first holes being opposingly positioned in the second pipe;

a plurality of second holes positioned in the third pipe such that the second holes of the plurality of second holes are substantially evenly spaced between opposed ends of the third pipe and such that each second hole of the plurality of second holes is opposingly positioned in the third pipe relative to an associated second hole of the plurality of second holes; and a pin selectively insertable through the pair of first holes, a respective second hole, and the associated second hole for fixedly positioning the third pipe relative to the second pipe.

* * * * *